US005542831A

United States Patent [19]

Scarfone

[11] Patent Number: 5,542,831

[45] Date of Patent: Aug. 6, 1996

[54] TWIN CYLINDER ROTARY COMPRESSOR

[75] Inventor: Tommaso F. Scarfone, Bayonne, N.J.

[73] Assignee: Carrier Corporation, Syracuse, N.Y.

[21] Appl. No.: 434,630

[22] Filed: May 4, 1995

[51] Int. Cl.[6] ..... F04C 18/356; F04C 23/00

[52] U.S. Cl. ..... 418/60; 29/888.025

[58] Field of Search ..... 418/60, 200, 212; 29/888.025

[56] References Cited

U.S. PATENT DOCUMENTS

| | | | |
|---|---|---|---|
| 254,069 | 2/1882 | Taylor | 418/60 |
| 2,584,865 | 2/1952 | Gordinier | 418/60 |
| 3,125,031 | 3/1964 | Rydberg et al. | 418/60 |
| 3,463,090 | 8/1969 | Gordinier | 418/60 |
| 4,370,111 | 1/1983 | Shea | 418/212 |
| 4,826,408 | 5/1989 | Inoue et al. | 418/60 |
| 4,990,073 | 2/1991 | Kudo et al. | 418/60 |

FOREIGN PATENT DOCUMENTS

| | | | |
|---|---|---|---|
| 61-286596 | 12/1986 | Japan | 418/60 |

*Primary Examiner*—John J. Vrablik

[57] ABSTRACT

A separator plate is provided in the pump cartridge assembly of a twin cylinder rotary compressor. The separator plate separates and coacts with other structure to define two distinct compression/suction chambers. Because there is only one correct assembly orientation, it provides automatic alignment of the two pump subassemblies making up the pump cartridge.

7 Claims, 5 Drawing Sheets

TWIN CYLINDER ROTARY COMPRESSOR

BACKGROUND OF THE INVENTION

In rolling piston or fixed vane compressors, the annular roller or piston is moved by the eccentric journal on the shaft such that the cylindrical surface has a very small clearance with the bore of the cylinder. In a single cylinder rotary compressor the ends of the annular roller or piston are, typically, in sealing contact with the pump and motor bearings, respectively. In a twin cylinder rolling piston compressor, the eccentric journals, and therefore the annular rollers, are 180° out of phase to provide a balanced operation. Also, in a twin cylinder rolling piston compressor, two additional facing ends of the annular rollers must be sealed. The sealing of the four axially spaced, moving ends of the annular rollers presents assembly and alignment problems.

SUMMARY OF THE INVENTION

With current state of the art manufacturing for either single or twin cylinder compressors, it becomes very difficult to align the bearings and at the same time control the clearance between the piston wall and the cylinder bore. This is because the assembly is "blind" and access inside the pump is impossible. This dimension has to be inferred from the outside. A separator plate, as disclosed in the present invention, serves two functions. First, it separates and defines two distinct compression/suction chambers separated by a vane. Second, it provides automatic alignment of the two pump subassemblies respectively made up of a cylinder and motor bearing, and a cylinder and pump bearing. The present invention thus allows for both bearings to be precisely located on each cylinder and in turn each cylinder is precisely located with respect to the other by the action of the plate intimately resting inside the precision recesses.

It is an object of this invention to readily align the two bearings of a twin cylinder rotary compressor.

It is another object of this invention to provide easier and more accurate assembly thereby improving reliability and efficiency. These objects, and others as will become apparent hereinafter, are accomplished by the present invention.

Basically, precision recesses are machined in each cylinder. A precision machined separator plate is received in the recesses and serves to self-align both pump assemblies which together make up the pump cartridge.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
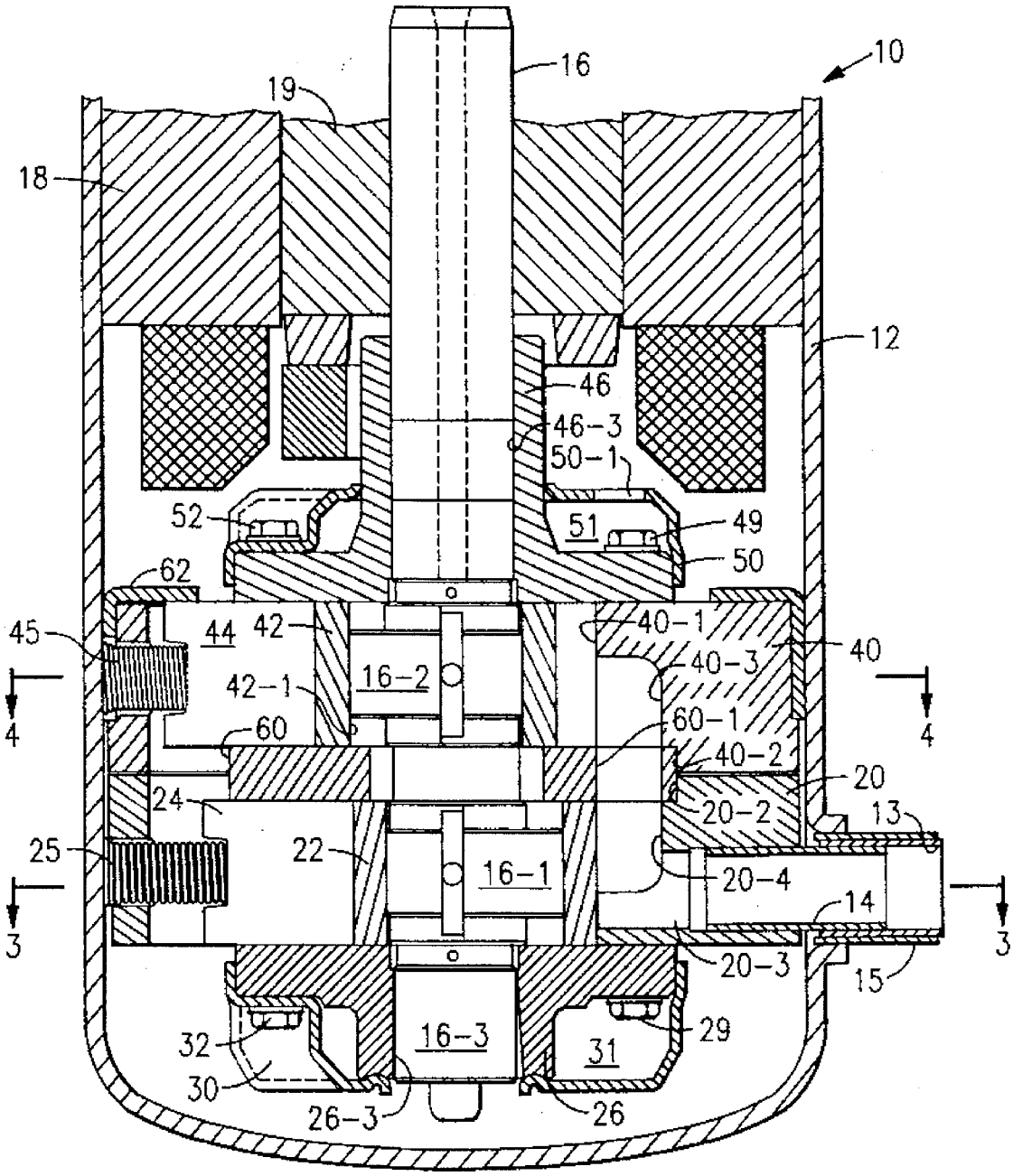
FIG. 1 is a partial, partially sectioned view of a vertical compressor taken generally along line 1—1 of FIG. 3.
Figure 2:
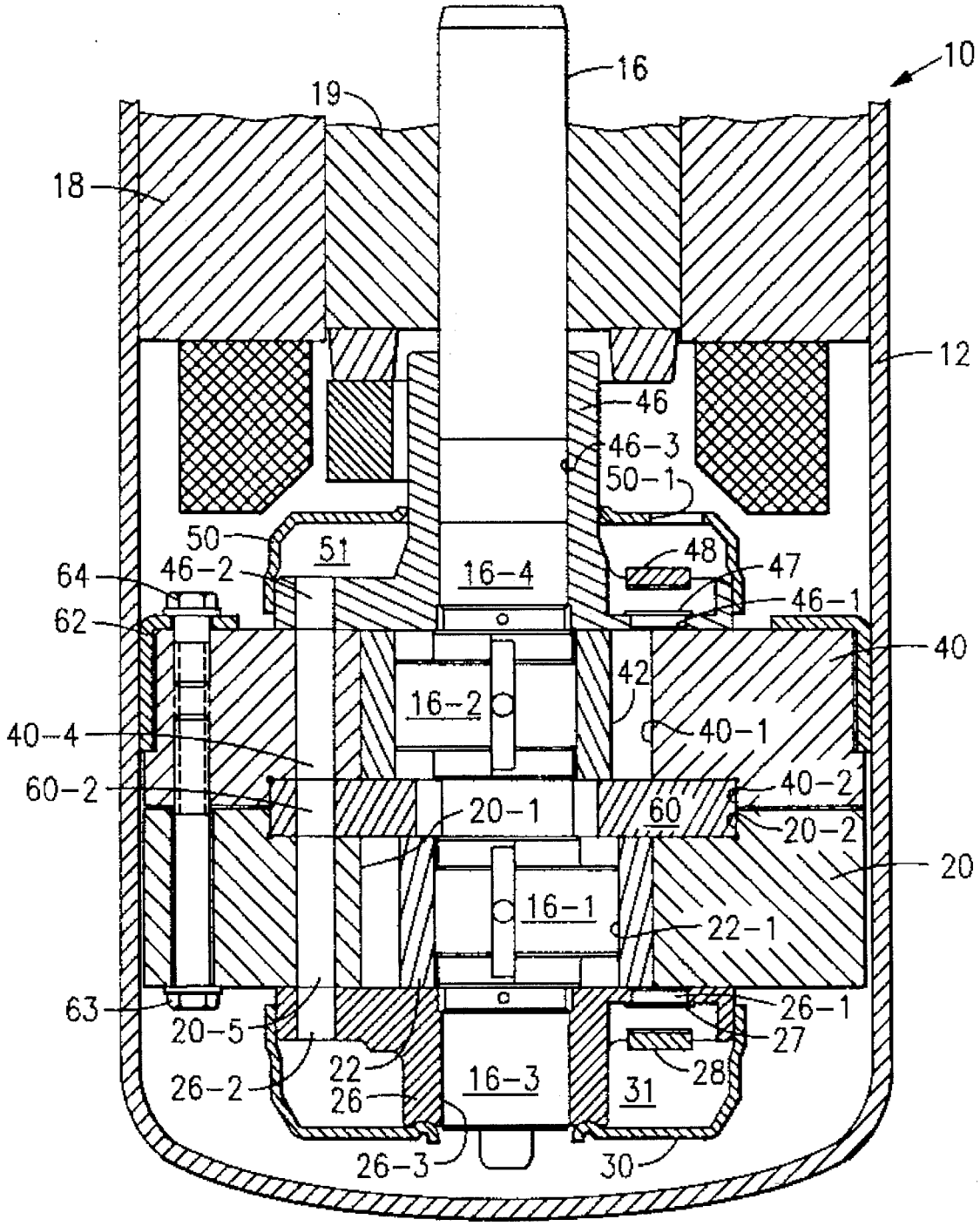
FIG. 2 is a partial, partially sectioned view taken generally along line 2—2 of FIG. 3.
Figure 3:
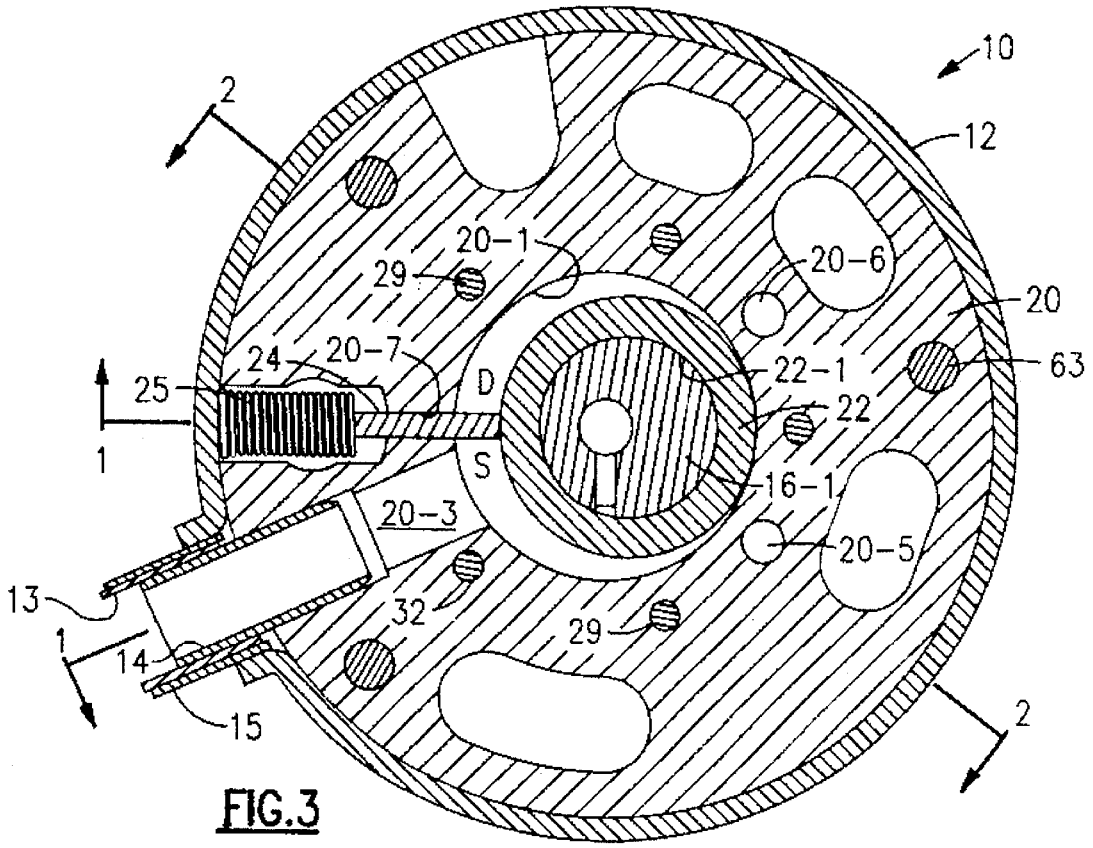
FIG. 3 is a sectional view taken generally along line 3—3 of FIG. 1.
Figure 4:
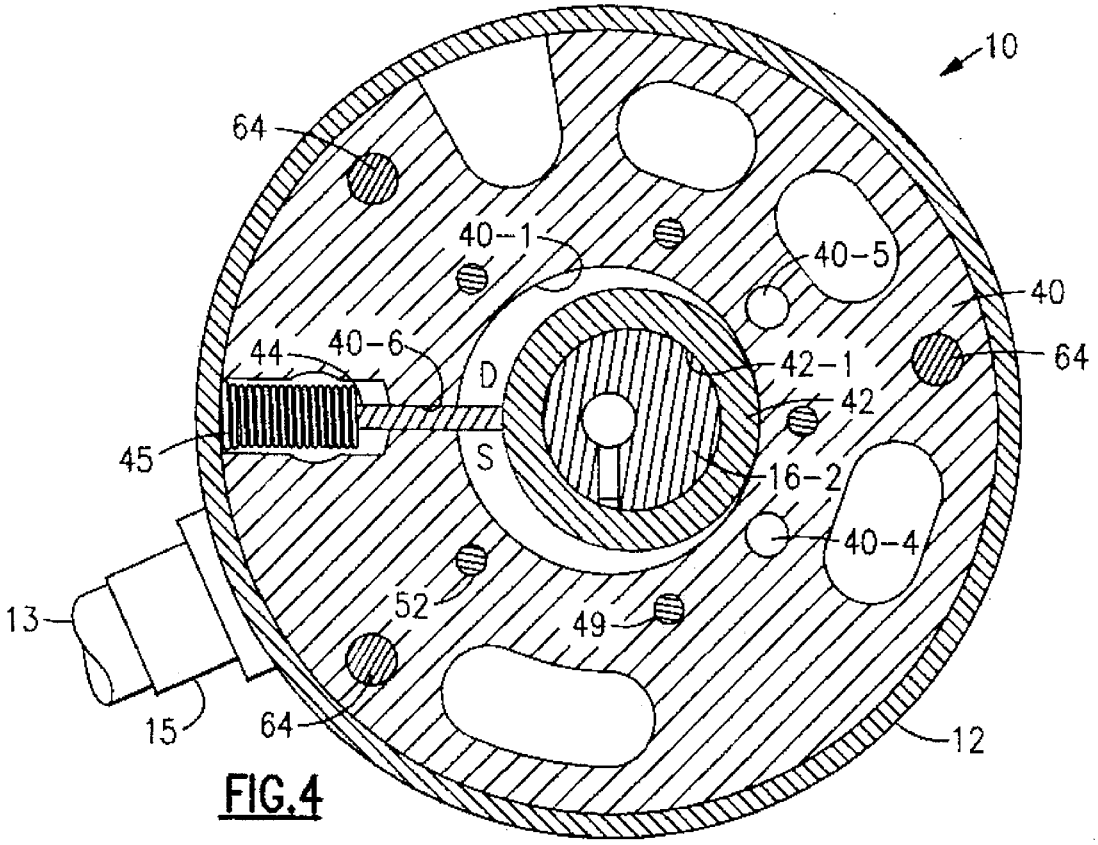
FIG. 4 is a sectional view taken generally along line 4—4 of FIG. 1 but with the crankshaft rotated 180°.

In FIGS. 1–4, the numeral 10 generally designates a twin cylinder, high side, vertical, hermetic rolling piston compressor having a shell 12. There are two pump assemblies which, together, make up a pump cartridge. The first or lower pump assembly includes cylinder 20 which has a bore 20-1. Annular piston 22 is located in cylinder bore 20-1 and receives eccentric journal 16-1 of eccentric shaft 16 in bore 22-1. Vane 24 is located in slot 20-7 and is biased into tracking contact with piston 22 by spring 25 and, as best shown in FIG. 3, divides the crescent shaped clearance between piston 22 and bore 20-1 into a suction chamber, S, and a discharge chamber, D. Pump bearing 26 underlies bore 20-1 and piston 22 while receiving the journal defining lower end 16-3 of shaft 16 in a bearing relationship. Pump bearing 26 is secured in place on cylinder 20 by a plurality of circumferentially spaced bolts 29. Discharge valve 27 and valve stop 28 are secured to bearing 26 such that discharge valve 27 coacts with valve stop 28 and discharge port 26-1 in pump bearing 26. Muffler 30 is secured to bearing 26 by bolts 32 and coacts therewith to define chamber 31. It should be noted that the only difference between bolts 29 and 32 is that bolts 32 additionally secure muffler 30 to bearing 26.

The second or upper pump assembly is similar to the first or lower pump assembly described above and includes cylinder 40 which has a bore 40-1. Annular piston 42 is located in cylinder bore 40-1 and receives eccentric journal 16-2 of eccentric shaft 16 in bore 42-1. Vane 44 is located in slot 40-6 and is biased into tracking contact with piston 42 by spring 45, and, divides the crescent shaped clearance between piston 42 and bore 40-1 into a suction chamber, S, and a discharge chamber, D. Motor bearing 46 overlies bore 40-1 and piston 42 while receiving the journal defining upper portion 16-4 of shaft 16 in a bearing relationship. Motor bearing 46 is secured in place on cylinder 40 by a plurality of circumferentially spaced bolts, 49 which correspond to bolts 29. Discharge valve 47 and valve stop 48 are secured to bearing 46 such that discharge valve 47 coacts with valve stop 48 and discharge port 46-1 in motor bearing 46. Muffler 50 is secured to bearing 46 by bolts 52 and coacts therewith to define chamber 51 which communicates with the interior of shell 12 via ports 50-1. It should be noted that the only difference between bolts 49 and 52 is that bolts 52 additionally secure muffler 50 to bearing 46.

Cylinders 20 and 40 are provided with precision machined recesses 20-2 and 40-2, respectively, which receive precision machined separator plate 60 therein. The precision machining is with respect to the centerline of compressor 10 so that, when assembled, recesses 20-2 and 40-2 and separator plate 60 are concentric with each other and with bores 20-1 and 40-1. As will be clear from a study of FIGS. 1 and 2, there are two distinct stackings of members between bearings 26 and 46. The first stacking serially includes bearing 46, cylinder 40, separator plate 60, cylinder 20 and bearing 26. The second stacking serially includes bearing 46, piston 42/vane 44, separator plate 60, piston 22/vane 24 and bearing 26. To prevent leakage the two stackings must be equal but for any clearance necessary to permit movement of pistons 22 and 42 and vanes 24 and 44. As noted, recesses 20-2 and 40-2 and separator plate 60 are precision machined and plate 60 is in both stackings.

Plate 60 corresponds to the recesses 20-2 and 40-2 in that it is slightly thicker than the total thickness of the combined depths of the recesses. As a result, plate 60 and pump bearing 26 provide sealed, lubricated contact, respectively, with the top and bottom of piston 22 and vane 24 while plate 60 and motor bearing 46 provide sealed, lubricated contact with the bottom and top, respectively, of piston 42 and vane 44. Additionally, plate 60 coacts with the recesses to radially locate the cylinders 20 and 40 with respect to each other, and to coaxially align the journal bearings 16-3 and 16-4 of shaft 16 with bearings 26 and 46.

An easier and more accurate aligning of the pump and motor bearings results from the precision machined separator plate and recesses. Automatic alignment of bearings 26 and 46 results from the locating of precision machined separator plate 60 in precision machined recesses 20-2 and 40-2 which radially and thereby axially align cylinders 20 and 40 and their bores 20-1 and 40-1, respectively. With bores 20-1 and 40-1 in alignment, misalignment of the associated members such as shaft 16 and pistons 22 and 42 is minimized, if not effectively eliminated. When the shaft 16 is properly aligned each subassembly consisting of a cylinder 20, 40 and bearing 26, 46 can be independently positioned with high accuracy in relation to the other and aligned as an assembly to form a pump cartridge when separator plate 60 is properly positioned in the machined recesses. Plate 60 is preferably round and, because of the need to align bores 60-1 and 60-2 with their corresponding fluid passages, has a single orientation to permit alignment of the suction and discharge passages. The completed assembly, or pump cartridge, consisting of plate 62 and the two subassemblies containing cylinders 20 and 40, respectively, are concentrically mounted and secured together with bolts 63 and 64 for eventual plug welding into the compressor shell.

In operation, compressor 10 is driven by an electric motor including stator 18, which is secured to shell 12, and rotor 19 which is secured to shaft 16 and which turns as a unit therewith. The coaction of vanes 24 and 44 with pistons 22 and 42, respectively, creates a reduced pressure that tends to draw gas from the refrigeration or air conditioning system (not illustrated). Gas passes serially through suction line 13 and tube 14 into radial bore 20-3 which leads directly into bore 20-1, as best shown in FIG. 3. As is best shown in FIG. 1, radial bore 20-3 also connects with axial bore 20-4 and serially via axial bores 60-1 and 40-3 with bore 40-1. Gas compressed in cylinder 20, as best shown in FIG. 2, passes through port 26-1 into chamber 31. Gas from chamber 31 can pass through either of two paths into chamber 51 as indicated by axial bores 20-5 and 20-6 in cylinder 20 and axial bores 40-4 and 40-5 in cylinder 40. In the path illustrated in FIG. 2, compressed gas from chamber 31 serially passes through bores 26-2 and 20-5, 60-2, 40-4 and 46-2 into chamber 51. Gas compressed in cylinder 40 passes through port 46-1 into chamber 51. Gas from chamber 51 passes through ports 50-1 into the interior of shell 12 and out the discharge (not illustrated).

In assembling compressor 10 it is initially necessary to obtain preliminary measurements. To insure that a minimum clearance is maintained at the point where the pressure in the chamber defined by bore 20-1, piston 22, vane 24, and pump bearing 26 and in the chamber defined by bore 40-1, piston 42, vane 44 and motor bearing 46 are slightly higher than the pressure in the shell 12, typically 60° before top dead center (tdc), the bearings 26 and 46 are positioned relative to cylinders 20 and 40, respectively, such that the radial distance from bore 26-3 to bore 20-1, and from bore 46-3 to bore 40-1 is greater than the distance from the outside diameter of piston 22 at tdc to a point 180° away on journal 16-3 or 16-4. The difference between the two distances regulates the clearance between bore 26-3 and bore 20-1 and between bore 46-3 and bore 40-1. For increased efficiency such clearance is held to a minimum.

Typically the clearance is on the order of 9–13 microns. Accordingly, eccentric 16-1 is inserted in bore 22-1 of piston 22 and eccentric 16-2 is inserted in bore 42-1 of piston 42. The top dead center dimensions are measured and recorded for each piston and eccentric. Shalt 16 is withdrawn from the pistons 22 and 42.

Figure 5:
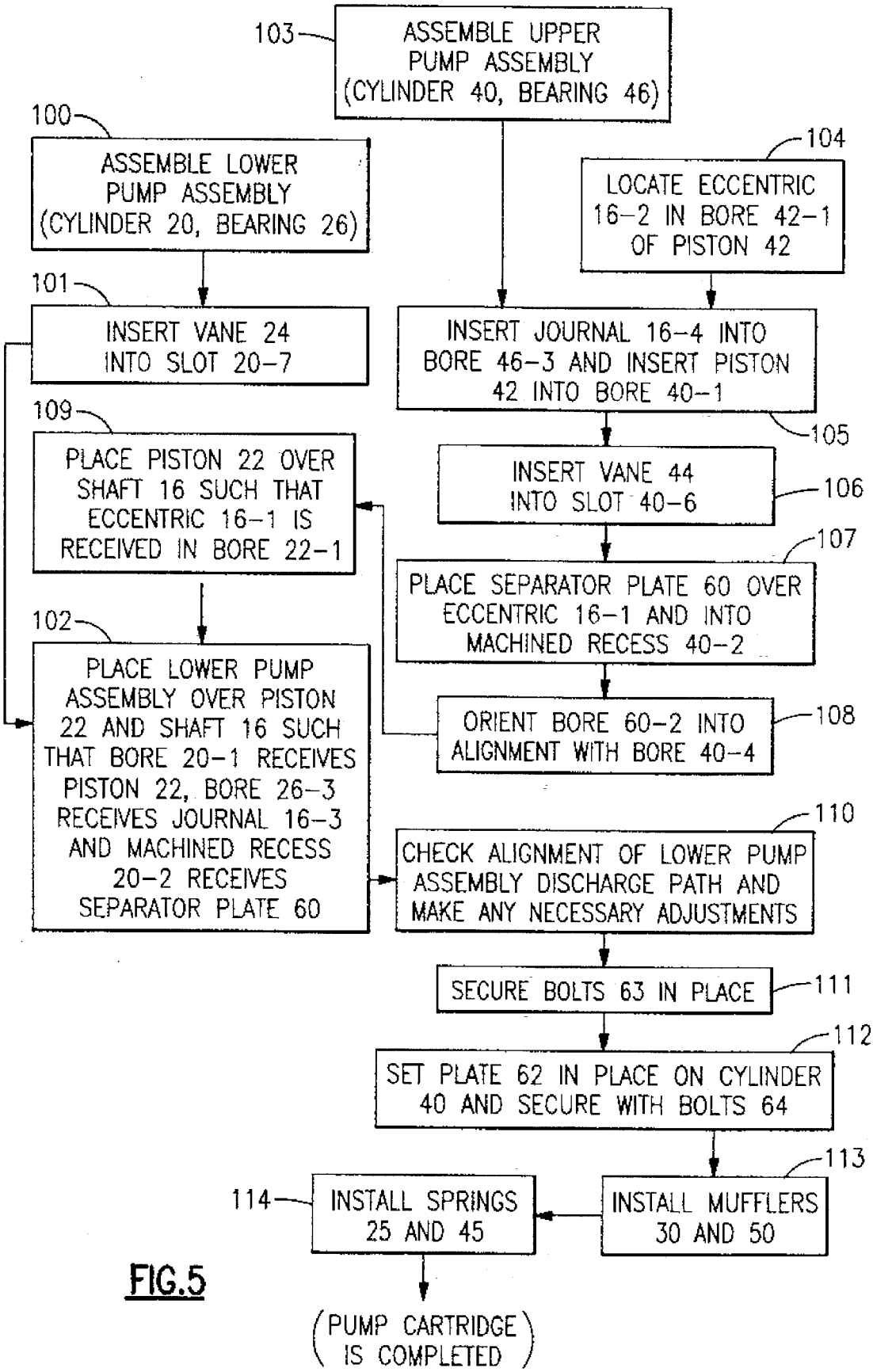
FIG. 5 is a schematic representation of the pump cartridge assembly method.

The assembly of the pump cartridge is schematically represented in FIG. 5. A first subassembly is made of cylinder 20 and pump bearing 26, as shown in box 100, and a second subassembly is made of cylinder 40 and motor bearing 46, as shown in box 103. The center of each bearing is located with respect to its cylinder such that the distance from its center is equal to the top dead center dimension measured for the corresponding piston/eccentric. Such dimension is to be at a point 60° prior to top dead center. Bolts 29 are installed to hold cylinder 20 and pump bearing 26 together in the proper position and bolts 49 are installed to similarly hold cylinder 40 and motor bearing 46 in proper position. As shown in box 104, eccentric 16-2 is placed in bore 42-1 of piston 42. Journal 16-4 of shalt 16 is inserted into bore 46-3 of motor bearing 46 as piston 42 is inserted into bore 40-1 of cylinder 40, as shown in box 105. Vane 44 is inserted in slot 40-6, as shown in box 106. Separator plate 60 is placed over eccentric 16-1 and into machined recess 40-2, as shown in box 107. Bore 60-2 is oriented so as to be in alignment with bore 40-4, as illustrated in FIG. 2 and shown in box 108. Piston 22 is placed over shalt 16 such that eccentric 16-1 is received in bore 22-1, as shown in box 109.

Vane 24 is inserted into slot 20-7, as shown in box 101. The structures of boxes 101 and 109 are joined with the subassembly of pump bearing 26, cylinder 20 and vane 24 being placed over piston 22 and shaft 16 such that bore 20-1 receives piston 22, bore 26-3 receives journal 16-3 of shalt 16 and machined recess 20-2 receives separator plate 60, as shown in box 102. The alignment of the discharge flow path of the lower pump subassembly defined by bores 26-2, 20-5, 60-2, 40-4 and 46-2 and/or the equivalent containing bores 20-6 and 40-5 is checked for alignment, and aligned if not already aligned, as shown in box 110. Bolts 63 are screwed into place to hold the assembly together, as shown in box 111. Plate 62 is set in place on cylinder 40 and held in place with bolts 64, as shown in box 112. Mufflers 30 and 50 are installed and held in place with bolts 32 and 52, respectively, as shown in box 113, and springs 25 and 45 are set in place, as shown in box 114. At this point the pump cartridge is assembled as a unit.

Figure 6:
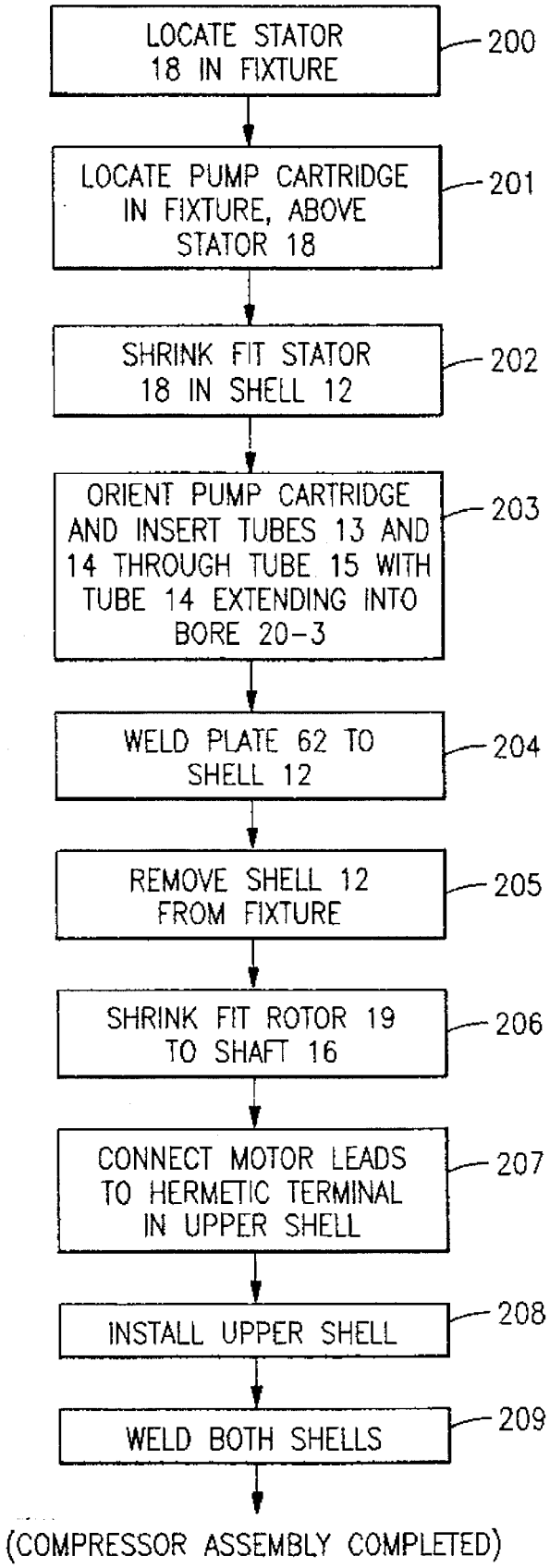
FIG. 6 is a schematic representation of the installation of the pump cartridge and completion of the compressor assembly.

With the pump cartridge assembled, the compressor assembly can be completed as shown in FIG. 6. Tube 15 is welded in place in shell 12 at any convenient time prior to completing the step of box 203. The stator 18 is located in a fixture, as shown in box 200, and the pump cartridge is located in the fixture above stator 18, as shown in box 201. Stator 18 is then shrunk fit in place in shell 12, as shown in box 202. The pump cartridge is oriented in the fixture to permit joined tubes 13 and 14 to be inserted through tube 15 such that tube 14 extends into bore 20-3, as shown in box 203. Plate 62 is then welded to shell 12, as shown in box 204, which secures the pump cartridge in the shell. Shell 12 containing the pump cartridge and stator 18 is removed from the fixture, as shown in box 205. The rotor 19 is then shrunk fit to shaft 16, as shown in box 206. The motor leads (not illustrated) will then be connected to the hermetic terminal (not illustrated) in the upper shell (not illustrated), as shown in box 207, and the upper shell will be installed in the lower shell of casing 12, as shown in box 208, and the shells welded, as shown in box 209. The compressor assembly will then be complete.

Although a preferred embodiment of the present invention has been illustrated and described, other changes will occur to those skilled in the art. For example, passage 20-4 can be replaced by a bore in cylinder 40 similar to 20-3 and tubes 13 and 14 can be replaced with a single tube. It is therefore intended that the scope of the present invention is to be limited only by the scope of the appended claims.

What is claimed is:

1. A twin cylinder rotary compressor means including:

a first and a second cylinder each having a first and a second end with a precision recess formed in said first end of said first and second cylinders;

a bore in each of said first and second cylinders extending from the corresponding precision recess to the corresponding second end;

bearing means facing said second end of said first and second cylinders;

a precision plate means located in and having a thickness exceeding the combined depths of said precision recesses in said first and second cylinders so as to precisely locate said bores in said first and second cylinders with respect to each other;

a first piston located in and axially coextensive with said bore in said first cylinder;

a second piston located in and axially coextensive with said bore in said second cylinder.

2. A twin cylinder rotary compressor means including a shell containing:

a first and a second cylinder each having a first and a second end with a precision recess formed in said first end of said first and second cylinders;

a bore in each of said first and second cylinders extending from the corresponding precision recess to the corresponding second end;

bearing means facing said second end of said first and second cylinders;

a precision plate means located in and having a thickness exceeding the combined depths of said precision recesses in said first and second cylinders so as to precisely locate said bores in said first and second cylinders with respect to each other;

a first piston located in and axially coextensive with said bore in said first cylinder;

a second piston located in and axially coextensive with said bore in said second cylinder;

first vane means coacting with said plate means, said bearing means facing said first cylinder, said first piston and said bore in said first cylinder to define a suction chamber and a discharge chamber;

second vane means coacting with said plate means, said bearing means facing said second cylinder, said second piston and said bore in said second cylinder to define a suction chamber and a discharge chamber;

means for driving said first and second pistons;

suction passage means for supplying suction gas to said suction chambers; and discharge passage means for delivering discharge gas from said discharge chambers.

3. The compressor means of claim 2 wherein said suction passage means is at least partially formed in said first and second cylinders and in said precision plate means.

4. The compressor means of claim 2 wherein said discharge passage means is at least partially formed in said first and second cylinders and in said precision plate means.

5. The compressor means of claim 4 further including muffler means secured to said bearing means and forming a portion of said discharge passage means.

6. A method of assembling a vertical twin cylinder rotary compressor comprising the steps of:

assembling a first pump assembly including a first cylinder and a first bearing;

assembling a second pump assembly including a second cylinder and a second bearing;

locating a first eccentric on a shaft in a bore of a first piston;

inserting a journal of said shaft into said first bearing and inserting said first piston into a bore in said first cylinder;

inserting a vane into a slot in said first cylinder;

placing a separator plate over a second eccentric on said shaft and into a machined recess in said first cylinder;

orienting bores in said separator plate and said first cylinder to provide a continuous flow path;

placing a second piston over said shaft such that said second piston receives said second eccentric;

inserting a vane into a slot in said second cylinder;

placing the second pump assembly over the second piston and the shaft such that the second cylinder receives the second piston, the second bearing receives a second journal of said shaft and a machined recess in said second cylinder receives said separator plate;

checking alignment of a discharge path in said second assembly with a corresponding bore in said separator plate and making any necessary adjustments;

securing the first and second pump assemblies together;

installing a muffler to each bearing;

installing springs for biasing said vanes in said first and second cylinders whereby a pump cartridge is completed;

securing said pump cartridge in a shell and completing assembly.

7. The method of claim 6 wherein said step of securing said pump cartridge in a shell includes the step of welding said pump cartridge in place in said shell.

* * * * *